United States Patent [19]

Trysinsky

[11] Patent Number: 4,671,511

[45] Date of Patent: Jun. 9, 1987

[54] ADJUSTABLE RACKET FRAMES

[76] Inventor: Stanley Trysinsky, #3 10720 97th Street, Edmonton, Alberta, Canada, T5H 2L8

[21] Appl. No.: 709,277

[22] Filed: Mar. 7, 1985

[51] Int. Cl.[4] ..... A63B 49/08

[52] U.S. Cl. ..... 273/73 J

[58] Field of Search ..... 273/73 J, 75, 81.5, 273/81.6, 72 R, 72 A, 87 D, 87 DA, 81 C, 81 Z, 80 D, 9; 74/551.9, 558, 558.5

[56] References Cited

U.S. PATENT DOCUMENTS

| | | | |
|---|---|---|---|
| 655,503 | 8/1900 | Moffett | 273/9 |
| 2,475,927 | 7/1949 | Verderber | 273/81.2 |
| 3,802,291 | 4/1974 | Young, Jr. et al. | 74/558 |
| 3,897,058 | 7/1975 | Koch | 273/81.2 X |
| 4,033,583 | 7/1977 | Ehrhart | 273/73 J X |
| 4,205,844 | 6/1980 | Gombas | 273/73 J X |
| 4,506,887 | 3/1985 | Trysinsky | 273/73 J X |
| 4,537,400 | 8/1985 | Adam | 273/75 |

FOREIGN PATENT DOCUMENTS

| | | | |
|---|---|---|---|
| 17012 | of 1928 | Australia | 273/75 |
| 27875 | 7/1930 | Australia | 273/75 |
| 729896 | 5/1955 | United Kingdom | 273/75 |

*Primary Examiner*—Anton O. Oechsle
*Assistant Examiner*—Matthew L. Schneider
*Attorney, Agent, or Firm*—Sughrue, Mion, Zinn, Macpeak & Seas

[57] ABSTRACT

Improvements in adjustable and other racket handles and shafts consisting of an improved durable yet light weight simplified unitized or self-integral structure which is firmly fixable and readily releasable by fully concealed internal wedges which are operated by a single long screw inside the handle and accessible from the bottom end. The detachable interchangeable handles are made in a range of outer sizes available in sets or singly from stock. The handle also has improvements in end cap shape and function. It also has innovative improvements in cover material form and application this being the use of a single standard sized diameter and tubular length of special kind of cover material and a material-stretching and locking rod applied against the material to lock it into a concealed groove positioned lengthwise within the handle. This comprises a new application for a special kind of elastomeric synthetic leather material, in a new way which improves handles.

5 Claims, 5 Drawing Figures

ADJUSTABLE RACKET FRAMES

CROSS REFERENCE TO RELATED APPLICATION

This application is directed to improvements in racket frames such as disclosed in Applicant's prior U.S. Pat. No. 4,506,887, granted Mar. 26, 1985. This application applies some of prior applications basic concepts to further improved embodiments for adjustability as modified to be applicable to twin-handles (dual-shafted) rackets.

BACKGROUND OF THE INVENTION

There are a number of instances where prior art proposes various forms of handle adjustability ranging from semi-permanent fixing means U.S. Pat. No. 3,833,219 Sept. 3rd 1974 to, rapidly movable slidable means for length adjustment with annular spacers (washers) proposed for perimetric handle grip size adjustment in one direction only U.S. Pat. No. 3,931,968 Jan. 13, 1976. A study of these and other art reveals that there are serious impracticalities or deficiencies which can be summarized as follows:

Too many round and other openings made into the shafts and handles cause structural weakness. Numerous access holes and wide long gaps between the cover material pieces expose metal screw head and nut parts along with wide gaps between the two handle pallets caused by the annular spacers, present a very broken rough uncomfortable surface for the hand to hold on to. It is difficult to apply the conventionally spirally wound cover materials over the numerous openings and further problems arise to gain access to numerous attaching screws operating levers etc.

The rapidly slidable handles must be rather loose in order to quickly and freely be moved. They require either, tiring sustained hand pressure to keep the handles secure in position on the shaft during play or in another version intermittent pressing of a lever is required to release the handle for length adjustment during play.

Keeping the hand in position to operate the release lever and button interferes with hand positions and changes required for the different serve, forehand, back hand and spin strokes. In the first version just relaxing the hand will cause the handle to slide loosely on the shaft. In the second version an inadvertent touch of pressure will cause the handle to slide loosely on the shaft at the most undesired time.

Clearly this extreme degree of rapid adjustability during play is undesirable. Such a method and control seriously hampers concentration on and achievement of the best hand positioning required for various strokes. The generally very large increase in the number of parts needed complicates and increases the cost of manufacturing such handles to a point of impracticability.

OBJECTS OF THIS INVENTION

Objects are to provide an improved racket structure and manner of use to yield: 1. "Anatomical Scaling" which is a concept, endorsed by leading Tennis Teaching Professionals that the racket length should be tailored to relate to the individual player's bodily anatomy, size and muscular ability. Some tennis rackets of different fixed lengths in integral non-adjustable structures are on the market but the shorter ones are available in only the lowest quality and poor appearance. 2.

Another object is to provide a standardized top quality racket having detachable interchangeable top quality handles of improved function and appearance, which can be very securely fixed at selected length positions for different players or for the same player as he grows up or develops. The handles are to be more durable, secure, comfortable, stronger (not easily broken) and at the same time significantly lighter to reduce fatigue caused by swinging non-working weight which has no ball-driving effect or benefit when located, not in the head, but in the lowest area of the handle where it only detrimentally increases the total inertia of the racket which makes quick strokes and changes of stroke direction at the net more difficult slower reacting and unecessarily tiring. 3. Another object is to provide improved perimetric or outer size adjustment of the handle-grips by supplying said detachable interchangeable handles in sets or singly from stock in a range of selectable outer sizes with the inside of all handles to be made in standard inside dimensions to fit precisely and securely on any one of the standard sized racket shafts. Thus the desired hand size and any shape or changes become quickly attainable at minimum cost without the need of buying a whole new expensive racket. A spare handle can be quickly attached while the other is removed for replacing worn cover material. 4. Another object is to provide improvements in form and design of the outer handle covering and the attaching means for the material and improvements in form and design fit and securing means of the top and bottom handle end elastomeric end caps as will be detailed further on.

DESCRIPTION OF THE PREFERRED EMBODIMENTS

Figure 3:
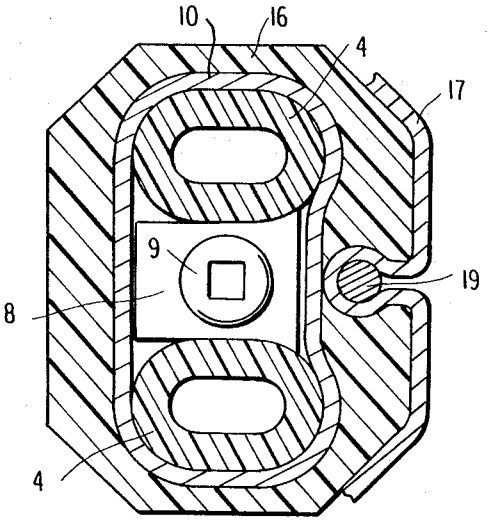
FIG. 3. is an enlarged cross-sectional view taken on the line 3—3 of FIG. 2.
Figure 2:
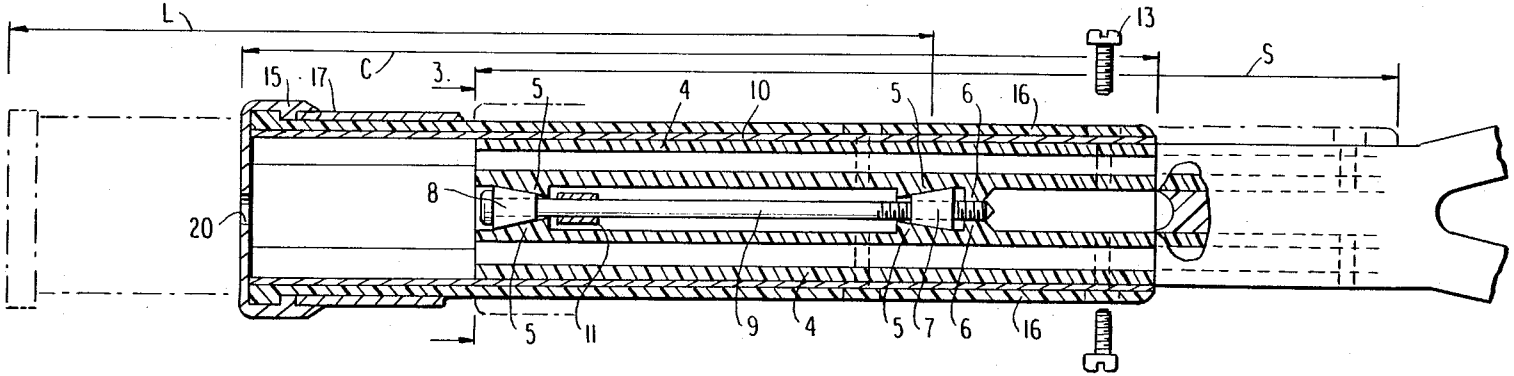
FIG. 2. is a lengthwise section of FIG. 1 incuding a part or broken away section where the twin shafts are bonded together including what is the only relevant portion of prior art's shaft.

Referring to the drawings, the twin shafts 4—4 in FIG. 2 and FIG. 3 are used in prior art in the form of twin or dual hollow tubes of fiber reinforced plastics material or metal. I-beam shaped extruded profiles of aluminum are also used. Various forms of fixed handles are structured integral with the shafts.

This invention differs in that it makes the twin shafts to precise standardized external dimensions along the area below the throat. It adds two pairs of raised bonded bosses 5—5 and two raised stops 6—6. The bosses have opposing inclined plane surfaces. The top tapered-faced wedge block 7 has an internally threaded hole. A second bottom wedge block 8 has a clear unthreaded hole. The long screw 9 passes freely through wedge block 8 and screws into wedge block 7. Turning clockwise the screw draws the two wedges together between the inclined faces to force the shafts outward and tighten them very securely against and within the high stength aluminum shell 10. Since the wedges can move independently of each other whichever one locks first the other one is free to move further until it also locks. Thus an equal force is applied at each inclined plane surface assuring firm contact over the entire area of the interfacing surfaces of shafts and aluminum shell for a maximum frictional grip. A suitable adhesive may be applied, followed by a light coating of aluminum oxide abrasive grit, 120 grit, to the appropriate surface areas of the shafts and allowed to dry. When assembled, a very modest turning force applied to the screw provides an amazingly strong attachment of the handle to the shaft. Alternatively a tough firm (polyurethane) coating may be bonded to the inner surface of the metal shell 10 to provide an adequate frictional grip and full security of the handle on the shafts. This alternative is desirable to prevent marring of exposable areas of glossy decorated shafts.

To release the handle the screw 9 is pressed inward and turned counterclockwise to force the threaded wedge block 7 out until it hits stops 6—6. Further outward turning causes the collar 11 to press on and release block 8. The handle may now be easily removed and exchanged for another of different outer size, or it may be moved along the shaft to another position and resecured to provide a different overall racket length. The letter C defines the conventional, 27 inch length position of the handle. L indicates a longer overall length while S is shorter.

Figure 1:
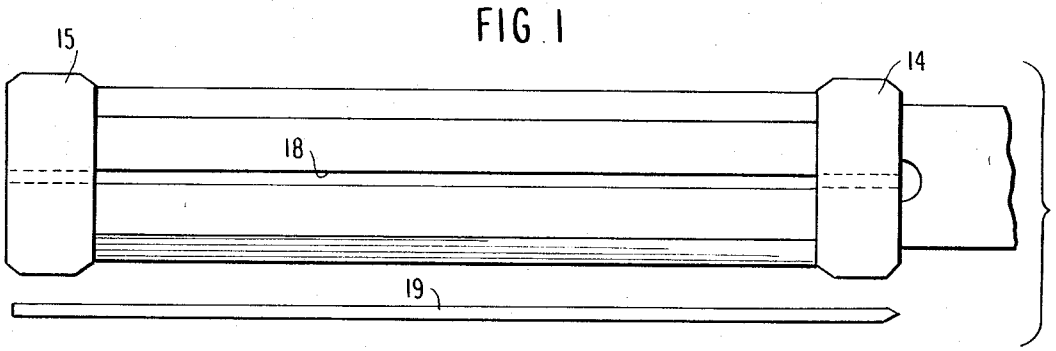
FIG. 1. is a top or plan view of the handle secured to the relevant portion of the racket shaft(s) including the cover-stretching and locking rod.

The screw 13 while not absolutely necessary can serve as a chosen position marker and extra safeguard. It tightens into a threaded hole in the material of the shaft to further secure the aluminum shell 10. The screw head is recessed flush with the surface of the handle and covered by the top end cap 14 FIG. 1 which has a large central opening to stretch over the shafts. Thus a smooth comfortable surface is provided. A bottom end cap 15 shown in section in FIG. 2 has a raised inner collar which holds securely over a mating outer collar molded on 16, the handle proper. These end caps neatly conceal and protect the edges of the cover material 17. A partial section view at 12 FIG. 2 shows a fibre-resin compound or dough material which bonds the two shafts together into a strong homogenous rectangular shape. Bottom cap 15 has a small access hole 20 for the handle tightening-removing tool, for example a square tipped Robertson screw driver, A spirally wound strip of cover material may be applied in the conventional manner over the handle with the endcaps used to improve appearance and durability.

The structural details described thus far are made to standard uniform dimensions to insure a precise fit of any handle on any shaft and provide interchangeability and adjustability for length.

Adjustability for a choice of external dimensions to fit different hand sizes and for any general outer shape desired is achieved by means of the rigid plastic foamed material, 16 FIG. 2 and FIG. 3, which is molded over and strongly bonded to the aluminum shell 10. This expanded plastic material is given a strong outer layer or self-"skin" resulting from an unfoamed portion of the material where it contacts the mold surface under temperature and pressure conditions which promote formation of the hard "skin".

The availability of these interchangeable handles in sets or singly from stock in a choice of outer sizes provides very convenient secure comfortable hand size adjustment means.

Figure 5:
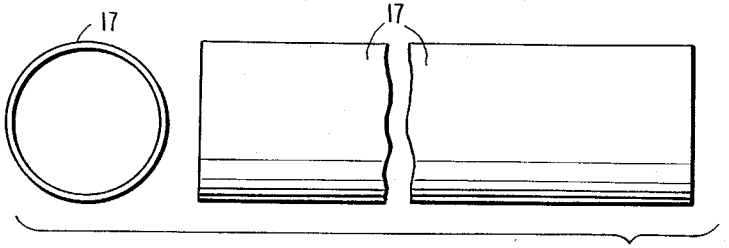
FIG. 5. is the tubular one-piece outer handle covering.
Figure 4:
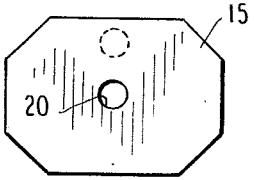
FIG. 4. is an external bottom end view of the handle.

Another important feature of the invention is the improved form of handle covering material and the means for it's application. FIG. 5 shows end and side views of the single tubular piece of material which is freely slipped over the handle. It is next pushed into the slot 18 using a thin flat tool. As the material reaches the bottom of the slot and groove the pointed end of the stretching-retaining rod 19 is applied into the groove from one end and spreads and stretches the material to fill the round wider groove below the slot as the full length of the rod is pushed into and concealed within the handle. Labor and adhesive are saved. The grip material is easily replaced by pulling the rod out to remove worn material.

To assure success of this embodiment it is best to use a special material such as QORO (coaguleather). It has a structure similar to fine leather except that the special short non-woven reinforcing fibres are imbedded and bonded into a strong elastomeric material (Polyurethane) matrix. The preferred form of QORO has a comfortable outer finish grip and feel like soft suede leather. The inner or bottom surface is a layer of soft elastomer only which provides both shock absorption and a secure frictional hold to the handle surface. The very low friction between the suede surface and the glossy stretching-locking rod eases stretching of the material into a firm friction grip of it's elastomeric inner surface around the outer surface of the handle and against the handle surface within the round groove.

The percentage of elongation (stretch) is not excessive but can accomodate the fitting of one common tube size on to a range of handles of different outer sizes.

This feature of the invention is an improved form and means for a new application method of the above said material to sports racket use.

Concepts of this invention can of course be readily adapted for and applied to other sports rackets made of other materials in a twinned or split shaft form.

What is claimed is:

1. A sports racket comprising:

an elongated hollow tube defining a head portion and a pair of parallel spaced apart shafts;

a first pair of identical opposed bosses disposed on opposing surfaces of said shafts adjacent the ends of said shafts and provided with opposed inclined surfaces diverging away form each other in the direction of the ends of the shafts;

a second pair of identical opposed bosses disposed on opposing surfaces of said shafts in spaced relation to said first pair of bosses in the direction of said head portion and provided with opposed inclined surfaces diverging away from each other in the direction of said head portion;

a first wedge block moveably disposed between said first pair of bosses and provided with inclined surfaces complimentary to the inclined surfaces of said first pair of bosses;

a second moveable wedge block disposed between said second pair of bosses and having inclined surfaces complimentary to the inclined surfaces of said second pair of bosses;

screw means extending freely through said first wedge block and having a head in engagement with one end of said first wedge block, and abutment disposed on said screw means adjacent the opposite end of said first wedge block and a threaded end portion of said screw means disposed in threaded engagement with a bore in said second wedge block; and a hollow elongated handle surrounding said shafts and detachably secured thereto, said hollow handle having opposed internal surfaces complimentary to the surfaces of said shafts opposite said bosses whereby upon rotation of said screw means in one direction said wedge blocks will be drawn toward each other to engage the bosses and force the shafts apart into tight frictional engagement with said opposed internal surfaces of said hollow handle and upon rotation of said screw means in the opposite direction said wedge blocks will be moved apart to allow said shafts to move toward each other and allow removal of said handle.

2. A sports racket as set forth in claim 1 further comprising coating means on the engaging surfaces of said handle and said shafts to increase the frictional grip when said surfaces are pressed together.

3. A sports racket as set forth in claim 1 further comprising additional screw means extending transversely through said handle and at least of one said shafts for providing additional attachment security of said handle to said shafts.

4. A sports racket as set forth in claim 1 further comprising an elongated tubular cover of elastomeric material surrounding said handle and having a circumferential dimension greater than the circumferential dimension of said handle, slit means extending lengthwise of said handle in the external surface thereof, said slit means expanding into a round groove extending lengthwise of the handle, and rod means removeably located in said groove for engaging the external surface of said tubular cover within said groove to stretch and lock the cover securely in place.

5. A sports racket comprising a head, a handle secured to said head, and a cover detachably secured to said handle said cover being comprised of an elongated tubular cover of elastomeric material having a circumferential dimension greater than the circumferential dimension of said handle, said handle having an elongated slit extending lengthwise of said handle and a round internal groove extending lengthwise of said handle coextensive with said slit and in communication with said slit and a cylindrical rod having a diameter greater than the width of said slit extending lengthwise of said groove in engagement with the outer surface of said tubular cover to stretch and lock said cover securely in place.

* * * * *